US012038206B2

(12) United States Patent
Kawano

(10) Patent No.: US 12,038,206 B2
(45) Date of Patent: Jul. 16, 2024

(54) WATER HEATER MOUNTING STRUCTURE

(71) Applicant: PALOMA CO., LTD, Nagoya (JP)

(72) Inventor: Keita Kawano, Nagoya (JP)

(73) Assignee: PALOMA CO., LTD, Nagoya (JP)

( * ) Notice: Subject to any disclaimer, the term of this patent is extended or adjusted under 35 U.S.C. 154(b) by 16 days.

(21) Appl. No.: 17/463,747

(22) Filed: Sep. 1, 2021

(65) Prior Publication Data

US 2022/0235967 A1 Jul. 28, 2022

(30) Foreign Application Priority Data

Jan. 27, 2021 (JP) ..... 2021-011388

(51) Int. Cl.
*F24H 9/06* (2006.01)
*F24H 9/02* (2006.01)

(52) U.S. Cl.
CPC ..... *F24H 9/06* (2013.01); *F24H 9/02* (2013.01)

(58) Field of Classification Search
CPC ..... F24H 9/06; F24H 9/02
USPC ..... 248/205.1
See application file for complete search history.

(56) References Cited

U.S. PATENT DOCUMENTS 1,771,742 A * 7/1930 Brombacher ..... F24H 9/06 122/494
4,917,077 A * 4/1990 Scanferla ..... F24H 9/148 126/344
5,131,133 A * 7/1992 Peterson ..... F24H 9/06 248/500
5,761,379 A * 6/1998 Lannes ..... F24H 9/06 122/13.01
6,338,460 B1 * 1/2002 Rumpel ..... F21S 4/10 362/396
7,926,777 B2 * 4/2011 Koesema, Jr. ..... H02G 3/30 24/336
10,234,171 B2 * 3/2019 Ando ..... F24H 9/06
11,041,657 B2 * 6/2021 Mori ..... F24H 9/20
(Continued)

FOREIGN PATENT DOCUMENTS

CN 207936489 U 10/2018
EP 1243868 B1 * 11/2006 ..... F24H 9/06
(Continued)

OTHER PUBLICATIONS

Office Action issued on May 23, 2024, in corresponding Japanese Application No. 2021011388, 8 pages.

*Primary Examiner* — Gregory A Wilson
(74) *Attorney, Agent, or Firm* — Maier & Maier, PLLC

(57) ABSTRACT

An object is to provide a water heater mounting structure for mounting a case to a mounting surface via a support fitting component that is fixed to the mounting surface in a vertical direction. The case houses a burning device. On a back plate of the case, a lock-engagement fitting component is mounted. The lock-engagement fitting component has an upper plate portion and a lower plate portion. The upper plate portion is fixed to the back plate, and the lower plate portion is lock-engageable with the support fitting component from thereabove and has a dimension longer than the support fitting component in the left-right direction. The lower plate portion is lock-engaged with the support fitting component from thereabove to hang and support the case through the lock-engagement fitting component by the support fitting component.

8 Claims, 9 Drawing Sheets

(56) References Cited

U.S. PATENT DOCUMENTS

| | | | | |
|---|---|---|---|---|
| 11,204,128 | B2 * | 12/2021 | Sugatani | F24H 9/06 |
| 2015/0108298 | A1 * | 4/2015 | Hanchett | F16M 13/022 248/205.1 |
| 2018/0058720 | A1 * | 3/2018 | Ando | F24H 9/06 |
| 2019/0049147 | A1 * | 2/2019 | Mori | F24H 1/181 |
| 2020/0370703 | A1 * | 11/2020 | Sugatani | F24H 9/06 |
| 2022/0235967 | A1 * | 7/2022 | Kawano | F24H 9/02 |

FOREIGN PATENT DOCUMENTS

| | | | | | |
|---|---|---|---|---|---|
| GB | 2458501 | A | * | 9/2009 | F24H 9/0094 |
| JP | 58006140 | U | | 1/1983 | |
| JP | S62031256 | U | | 2/1987 | |
| JP | S63175765 | U | | 11/1988 | |
| JP | 2003279162 | A | | 10/2003 | |
| JP | 2005147529 | A | | 6/2005 | |
| JP | 2018-31531 | A | | 3/2018 | |
| JP | 2019124378 | A | | 7/2019 | |
| JP | 2020190315 | A | | 11/2020 | |
| JP | 2021067371 | A | * | 4/2021 | F24H 9/0005 |

* cited by examiner

WATER HEATER MOUNTING STRUCTURE

This application claims the benefit of Japanese Patent Application Number 2021-011388 filed on Jan. 27, 2021, the entirety of which is incorporated by reference.

BACKGROUND OF THE INVENTION

Field

The present invention relates to a structure for mounting a water heater to a mounting surface such as a wall surface.

Background

A water heater has a burning device in a case. The burning device includes a burner, a heat exchanger, and the like. The water heater is mounted by using a first fitting component mounted to a mounting surface such as a wall surface of a building, and a second fitting component disposed at a back surface portion of the case, as disclosed in, for example, Japanese Laid-Open Patent Publication No. 2018-31531. The first fitting component has an L-shaped support portion that is raised toward the upper-front side. The second fitting component has a lower-side engagement piece that engages with the support portion from above the support portion, and an upper-side extending portion that is screwed to the mounting surface.

The water heater is mounted in the following manner. Firstly, the engagement piece of the second fitting component is lock-engaged with the support portion of the first fitting component from above the support portion. After a position of the case is adjusted, a positioning screw is screwed into the mounting surface through a keyhole-shaped opening formed in the extending portion to position (provisionally attach) the water heater. Thereafter, bolts are screwed (fully attached) into the mounting surface through screw insertion holes formed in the extending portion to complete the mounting of the water heater.

SUMMARY

In the mounting structure disclosed in Japanese Laid-Open Patent Publication No. 2018-31531, since the second fitting component is used both for provisionally attaching and fully attaching the case, the second fitting component is mounted to the upper end of the case. Therefore, the first fitting component is also mounted to the mounting surface at a high position, and the case needs to be lifted to a high position in order to mount the engagement piece to the first fitting component, so that a work load on a worker is increased. Furthermore, since the engagement piece of the second fitting component is behind the back surface of the case, and not visible to the worker, smooth alignment of the engagement piece and the support portion of the first fitting component with each other is difficult, and the provisional attaching is likely to increase load and time.

Therefore, an object of the present invention is to provide a water heater mounting structure that facilitates and assures alignment in mounting the water heater, and can provide excellent workability.

In order to attain the aforementioned object, the present invention is directed to a water heater mounting structure for mounting a case in which a burning device is housed, to a mounting surface, via a support fitting component. The support fitting component is fixed to the mounting surface in a vertical direction and that has a lock-engaged portion facing upward. A lock-engagement fitting component is mounted to a back surface of the case, and includes a fixed portion and a lock-engaging portion. The fixed portion is fixed to the back surface. The lock-engaging portion is joined to the fixed portion, is lock-engageable with the lock-engaged portion from above the lock-engaged portion, and has a dimension longer than that of the lock-engaged portion in a left-right direction. The lock-engaging portion is lock-engaged with the lock-engaged portion from above the lock-engaged portion to hang and support the case through the lock-engagement fitting component by the support fitting component.

According to another aspect of the present invention, in the above-described configuration, the lock-engaging portion is disposed over almost an entire length of a width of the back surface of the case in the left-right direction.

Here, the "almost an entire length of a width in the left-right direction" refers to both a length that is equal to a width in the left-right direction and a length that is slightly less than a width in the left-right direction.

According to another aspect of the present invention, in the above-described configuration, the lock-engaging portion has a turned-back portion at a lower end. The turned-back portion extends in the left-right direction, and comes into contact with the support fitting component in a state where the lock-engaging portion is lock-engaged with the lock-engaged portion.

According to another aspect of the present invention, in the above-described configuration, the turned-back portion has an insertion portion in which a thickness in a front-rear direction is increased upward from a lower end so as to form an acute angle, and the insertion portion has a forward tilting front surface.

According to another aspect of the present invention, in the above-described configuration, stoppers for preventing the lock-engaged portion from falling from the lock-engaging portion are disposed on both left and right sides of the lock-engaging portion.

According to another aspect of the present invention, in the above-described configuration, the lock-engaged portion is plate-shaped.

According to another aspect of the present invention, in the above-described configuration, a mounting fitting component is fixed to the back surface above the lock-engagement fitting component. The mounting fitting component has a provisionally attaching hole that is lock-engageable with a screw disposed at the mounting surface, and a fully attaching hole through which a screw is screwed into the mounting surface. The case is mountable to the mounting surface through the mounting fitting component in a state where the case is hung and supported by the support fitting component.

According to another aspect of the present invention, in the above-described configuration, the support fitting component includes a fixed plate portion which is fixed to the mounting surface, a horizontal plate portion that is bent forward from an upper end of the fixed plate portion, and the lock-engaged portion that is bent upward from a front end of the horizontal plate portion.

According to the present invention, the lock-engagement fitting component that is sufficiently longer than the lock-engaged portion in the left-right direction can be easily lock-engaged with the support fitting component without visually performing strict alignment. Furthermore, slight adjustment of the left and right mounting positions can be performed in a state where the case is hung and supported by the support fitting component, and the case is unlikely to fall during the adjustment. Therefore, alignment can be easily and assuredly performed during the mounting, and workability is made excellent. Furthermore, since the width of the support fitting component is less than that of the lock-engagement fitting component in the left-right direction, the support fitting component does not project from the left and right sides of the case in a mounted state.

According to another aspect of the present invention, in addition to the above-described effect, the lock-engaging portion is disposed over almost the entire length of the width of the back surface of the case in the left-right direction. Therefore, in a case where the lock-engaging portion is lock-engaged with the support fitting component, the lock-engaging portion can be visually checked easily from the lateral side, and is easily lock-engaged with the support fitting component.

According to another aspect of the present invention, in addition to the above-described effect, the lock-engaging portion has, at the lower end, the turned-back portion that extends in the left-right direction and comes into contact with the support fitting component in a state where the lock-engaging portion lock-engages with the lock-engaged portion. Therefore, the turned-back portion comes into line contact with the support fitting component and sliding relative to the support fitting component in the left-right direction is smoothly performed, so that slight adjustment of the left and right mounting positions can be easily performed.

According to another aspect of the present invention, in addition to the above-described effect, the turned-back portion has the insertion portion in which the thickness in the front-rear direction is increased upward from the lower end so as to form an acute angle, and the front surface of the insertion portion is tilted forward. Therefore, the lock-engaging portion is easily lock-engaged with the support fitting component. Further, the case and the lock-engagement fitting component are both guided toward the mounting surface by tilting of the front surface when the front surface of the insertion portion has come into contact with the support fitting component.

According to another aspect of the present invention, in addition to the above-described effect, the stoppers are disposed on both the left and right sides of the lock-engaging portion for preventing the lock-engaged portion from falling from the lock-engaging portion. Therefore, during slight adjustment of the left and right mounting positions, the lock-engaged portion can be assuredly prevented from falling from the lock-engagement fitting component.

According to another aspect of the present invention, in addition to the above-described effect, the lock-engaged portion is plate-shaped. Therefore, the structure of the support fitting component is simplified, and lock-engagement of the lock-engagement fitting component can also be facilitated.

According to another aspect of the present invention, in addition to the above-described effect, the mounting fitting component having the provisionally attaching hole that can be lock-engaged with a screw disposed at the mounting surface and the fully attaching holes through which screws can be screwed into the mounting surface, is fixed to the back plate above the lock-engagement fitting component. Therefore, the case can be firmly mounted to the mounting surface by also using the mounting fitting component. The lock-engagement fitting component can be positioned at a low position, and the support fitting component is also mounted at a position lower than that of the mounting fitting component so as to correspond to the lock-engagement fitting component. Therefore, the height to which the case is lifted during the mounting can be lowered.

According to another aspect of the present invention, in addition to the above-described effect, the support fitting component is structured to have the fixed plate portion, the horizontal plate portion, and the lock-engaged portion, and, thus, only the lock-engaged portion projects upward. Therefore, when the lock-engaging portion is lock-engaged with the lock-engaged portion, the lock-engaging portion can be smoothly inserted between the lock-engaged portion and the mounting surface without interfering with another portion.

DETAILED DESCRIPTION OF THE EMBODIMENTS

An embodiment of the present invention will be described below with reference to the drawings.

Figure 1:
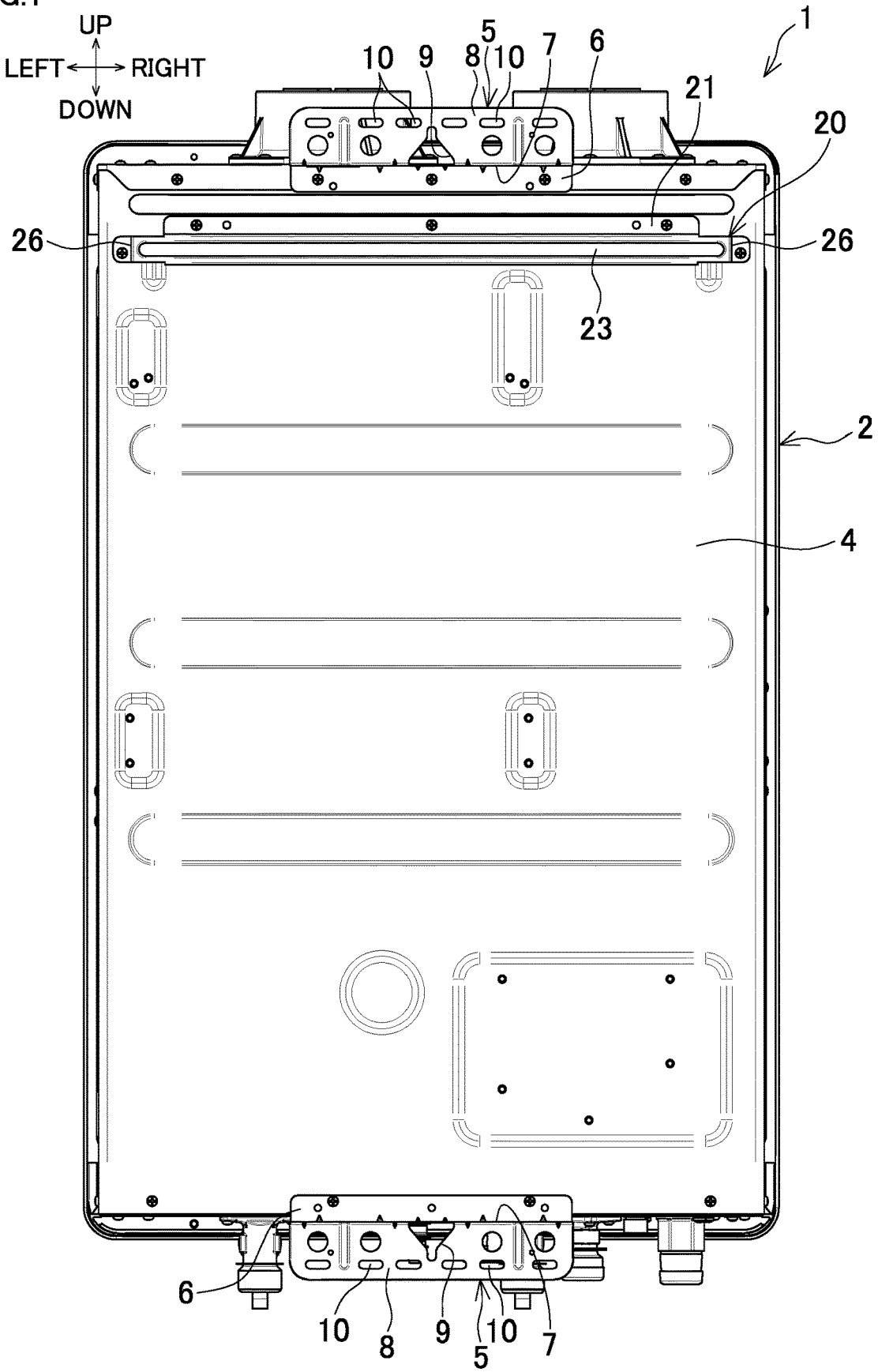
FIG. 1 is a rear view of a water heater.
Figure 2:
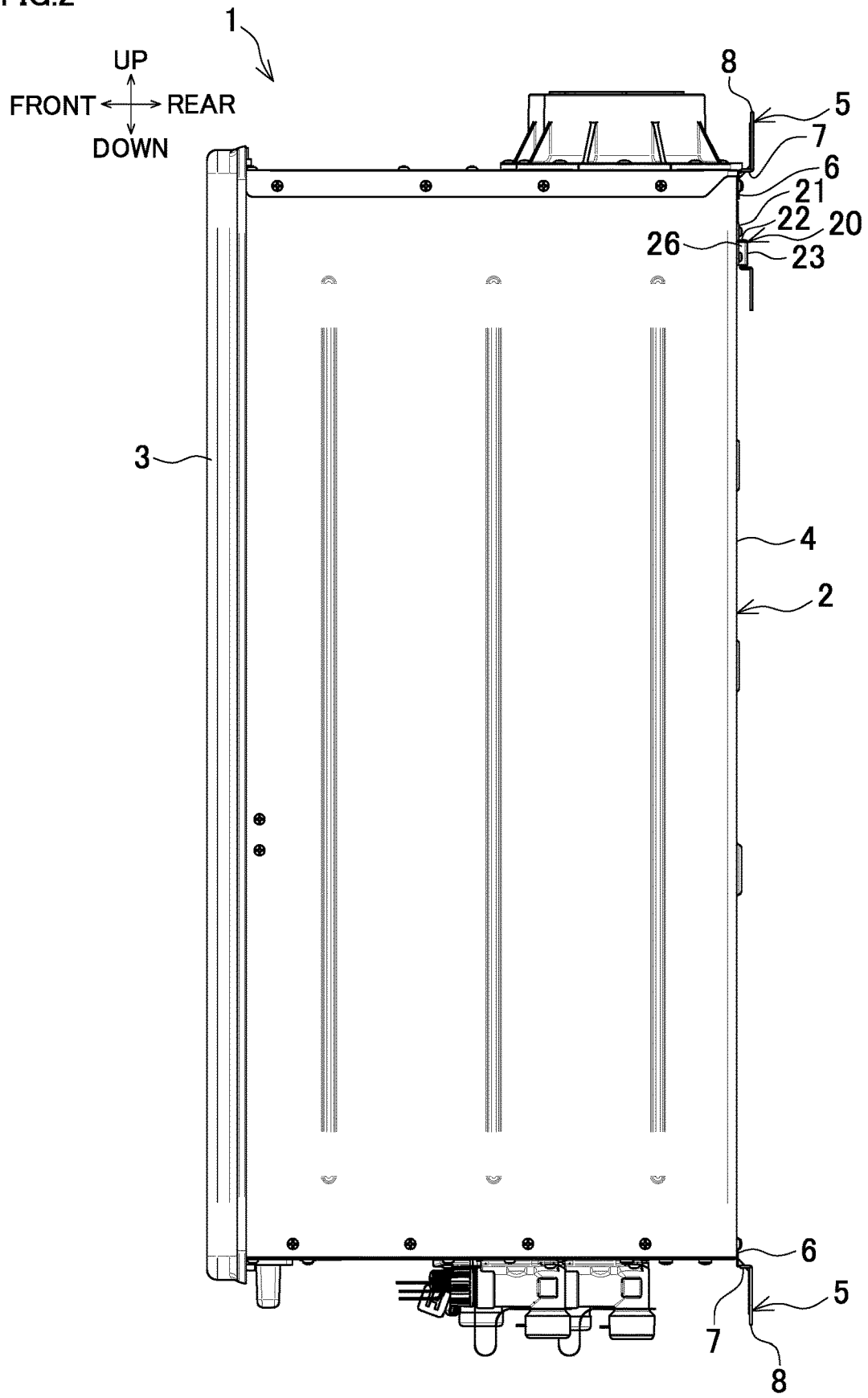
FIG. 2 is a side view of the water heater.

FIG. 1 is a rear view of an example of a water heater. FIG. 2 is a side view thereof.

A water heater 1 includes a longitudinally-elongated-box-shaped case 2 having an opening formed in a front surface, and a front cover 3 for closing the front surface of the case 2. In the case 2, components of, for example, a burning device including a burning portion having a burner, a heat exchange portion having a heat exchanger, and an exhaust portion, are housed.

Mounting fitting components 5, 5 for mounting the water heater 1 on a mounting surface such as a wall surface are disposed on the upper and lower sides of a back plate 4 forming the back surface of the case 2. Each mounting fitting component 5 is a metal plate that has a case-side mounting portion 6 which is screwed to the back plate 4, a bent portion 7 that is bent backward from the case-side mounting portion 6, and a wall-side mounting portion 8 that is bent upward from the rear end of the bent portion 7.

The wall-side mounting portion 8 has a laterally-elongated-rectangular shape, and has a provisionally attaching hole 9 at the center in the left-right direction. The provisionally attaching hole 9 is lock-engaged with, for example, a provisionally attaching screw disposed at the mounting surface. A lower side portion of the provisionally attaching hole 9 has such a tapered shape that the opening is increased downward. On the left and right sides of the provisionally attaching hole 9, a plurality of fully attaching holes 10, 10 are each formed in an elongated-circle-like shape extending in the left-right direction. Screws are screwed into the mounting surface through the plurality of fully attaching holes 10, 10.

Figure 3B:
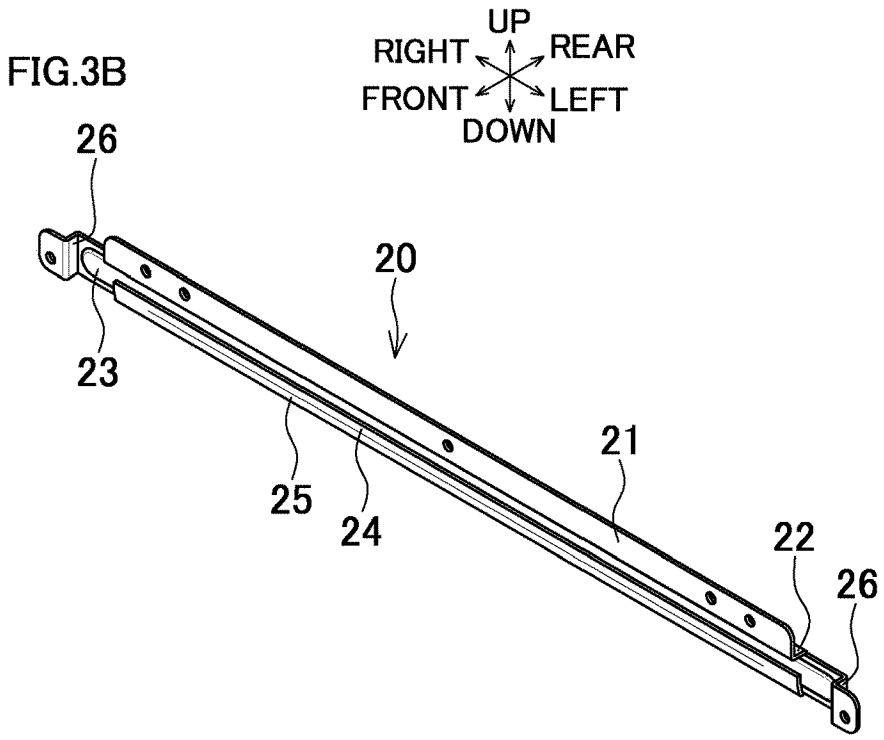
FIG. 3B is a perspective view of the lock-engagement fitting component as viewed from the front side thereof.
Figure 3A:
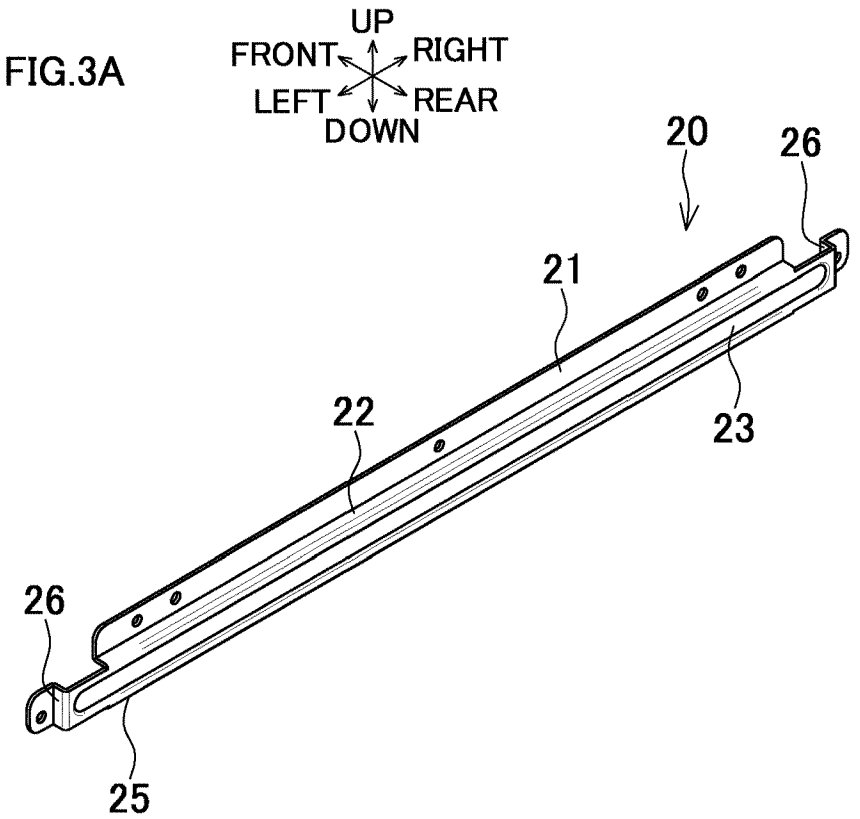
FIG. 3A is a perspective view of a lock-engagement fitting component as viewed from the rear side thereof.

A lock-engagement fitting component 20 is mounted to the back plate 4 below the mounting fitting component 5 disposed on the upper side. The lock-engagement fitting component 20 includes an upper plate portion 21, an intermediate plate portion 22, and a lower plate portion 23, as shown also in FIG. 3A, FIG. 3B and FIG. 4.

The upper plate portion 21 has a band-like shape extending in the left-right direction, and a width of the upper plate portion 21 in the left-right direction has a length greater than that of the mounting fitting component 5 and slightly less than that of the back plate 4. In the upper plate portion 21, both left and right ends and the center portion are screwed to the back plate 4.

The intermediate plate portion 22 extends backward from the lower end of the upper plate portion 21, and has a band-like shape having the same width as that of the upper plate portion 21 in the left-right direction.

The lower plate portion 23 extends downward from the rear end of the intermediate plate portion 22, and has a band-like shape having a width greater than that of the intermediate plate portion 22 in the left-right direction. At the lower end of the lower plate portion 23, in the center portion excluding both the left and right ends, a turned-back portion 24 is formed by hemming as shown also in FIG. 5. The turned-back portion 24 is turned back toward the front side so as to have an overlapping portion on the inner side. The turned-back portion 24 forms such an acute angle that a thickness in the front-rear direction is increased upward from the lower end, and the lower end of the turned-back portion 24 is an insertion portion 25 having the front surface formed as a tilted surface.

Both the left and right ends of the lower plate portion 23 are bent forward, and are then bent outward in the left-right direction to form stopper pieces 26, 26 that are L-shaped in a planar view. Each of the outward-bent portions of the stopper pieces 26 is screwed to the back plate 4. Therefore, a lock-engagement space 27 is formed below the intermediate plate portion 22 so as to have a rear portion closed by the lower plate portion 23, both left and right sides closed by the stopper pieces 26, 26, and an opened lower portion.

Figure 4:
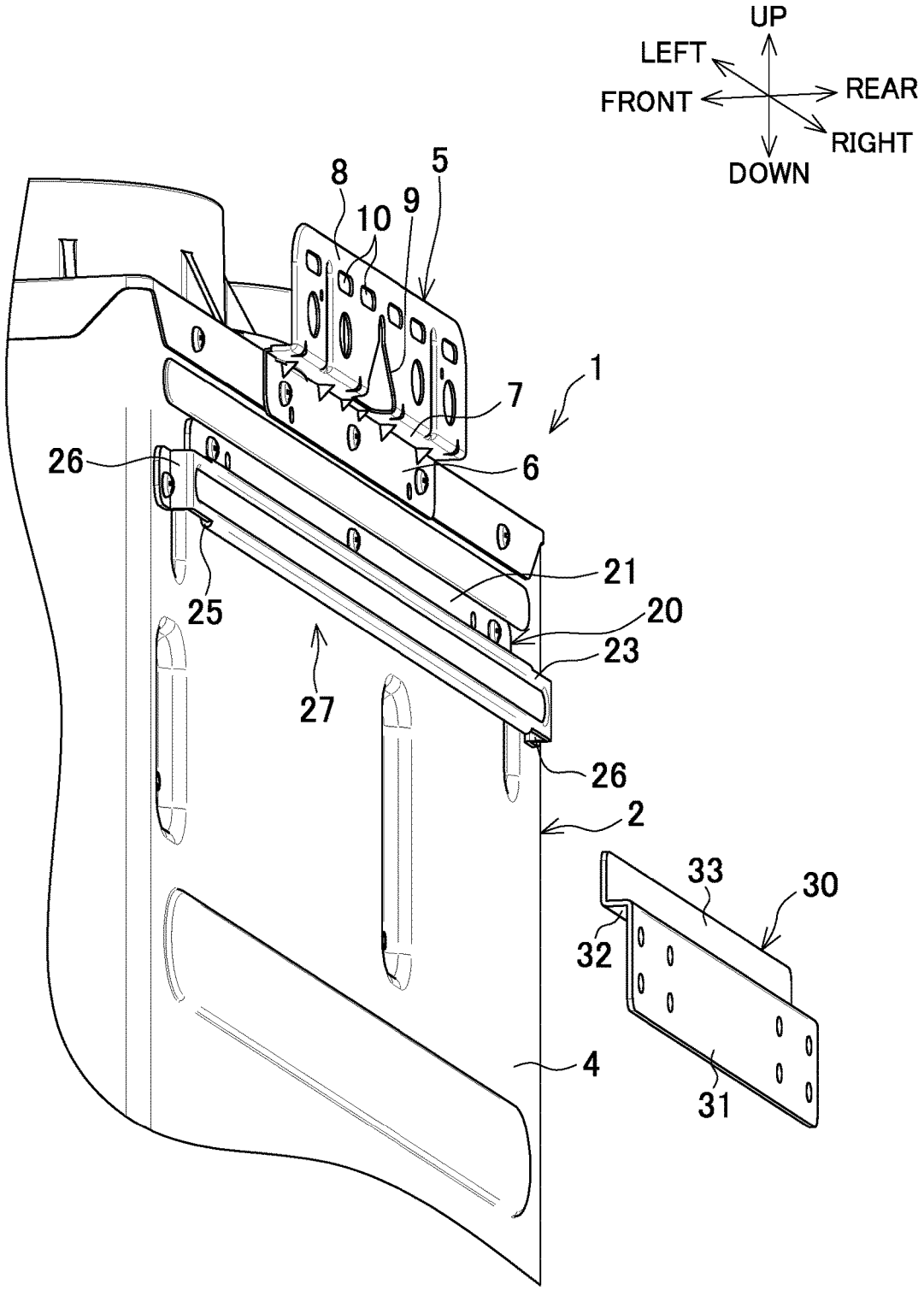
FIG. 4 is a perspective view of the water heater and a support fitting component as viewed from the rear sides thereof (a wall surface is not shown).

A support fitting component 30 that lock-engages with the lock-engagement fitting component 20 is mounted on a wall surface W (FIG. 5) as the mounting surface. As shown in FIG. 4, the support fitting component 30 has a fixed plate portion 31 which is fixed to the wall surface W by screws or the like, a horizontal plate portion 32 that is bent forward from the upper end of the fixed plate portion 31, and a lock-engagement plate portion 33 that is bent upward from the front end of the horizontal plate portion 32. The lock-engagement plate portion 33 has a band-like shape extending in the left-right direction, and is formed such that the width of the lock-engagement plate portion 33 in the left-right direction is less than (about half or less) the width of the lock-engagement space 27 of the lock-engagement fitting component 20 in the left-right direction.

In a case where the water heater 1 having the structure as described above is mounted to the wall surface W, the lock-engagement fitting component 20 is mounted to the back plate 4, and the support fitting component 30 is mounted to the wall surface W.

Figure 5:
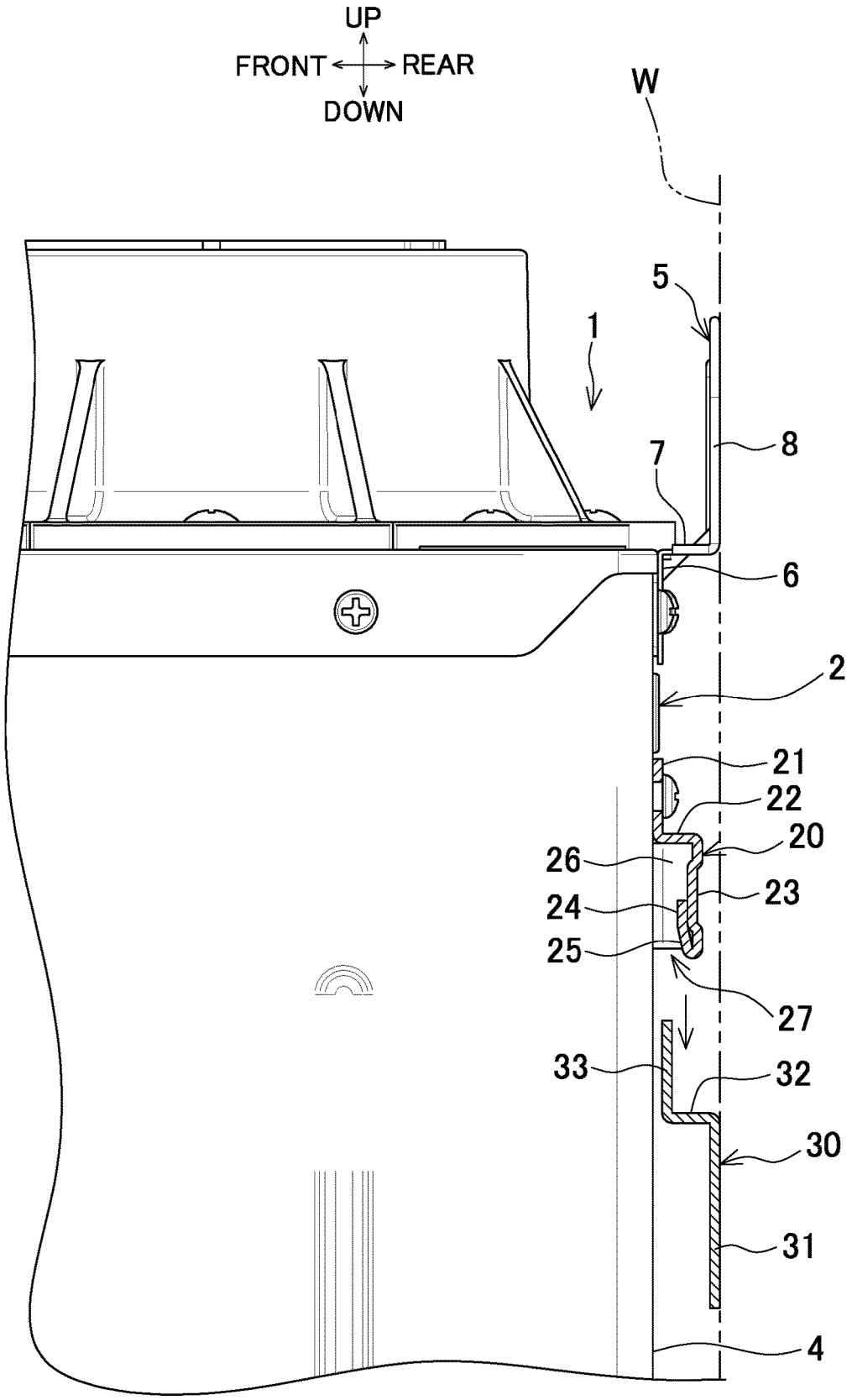
FIG. 5 is an explanatory view illustrating a state where the lock-engagement fitting component is being lock-engaged with the support fitting component as viewed from the side surfaces (both the fitting components are shown as their cross-sections).

Next, as shown in FIG. 5, the back plate 4 is faced toward the wall surface W and the case 2 is lifted to a height at which the lock-engagement fitting component 20 is slightly above the support fitting component 30, and the case 2 is moved backward until the mounting fitting component 5 comes into contact with the wall surface W. In this state, the case 2 is moved downward. Then, as shown in FIG. 6, the lock-engagement plate portion 33 of the support fitting component 30 is inserted relative to the lock-engagement space 27 of the lock-engagement fitting component 20 from below the lock-engagement space 27, and the lower plate portion 23 is inserted between the lock-engagement plate portion 33 and the wall surface W from above the lock-engagement plate portion 33.

At this time, since the lower plate portion 23 of the lock-engagement fitting component 20 has, at the lower end, the insertion portion 25 forming the acute angle, the lock-engagement plate portion 33 is smoothly inserted. Particularly, since the front surface of the insertion portion 25 is a tilted surface, even if the front surface of the insertion portion 25 comes into contact with the lock-engagement plate portion 33, the case 2 and the lock-engagement fitting component 20 are both guided toward the wall surface W by the tilting of the front surface.

Furthermore, the width of the lock-engagement space 27 in the left-right direction is sufficiently greater than the width of the lock-engagement plate portion 33 in the left-right direction. Thus, even if a small deviation in the left-right direction occurs, the lock-engagement plate portion 33 is assuredly guided into the lock-engagement space 27.

Figure 6:
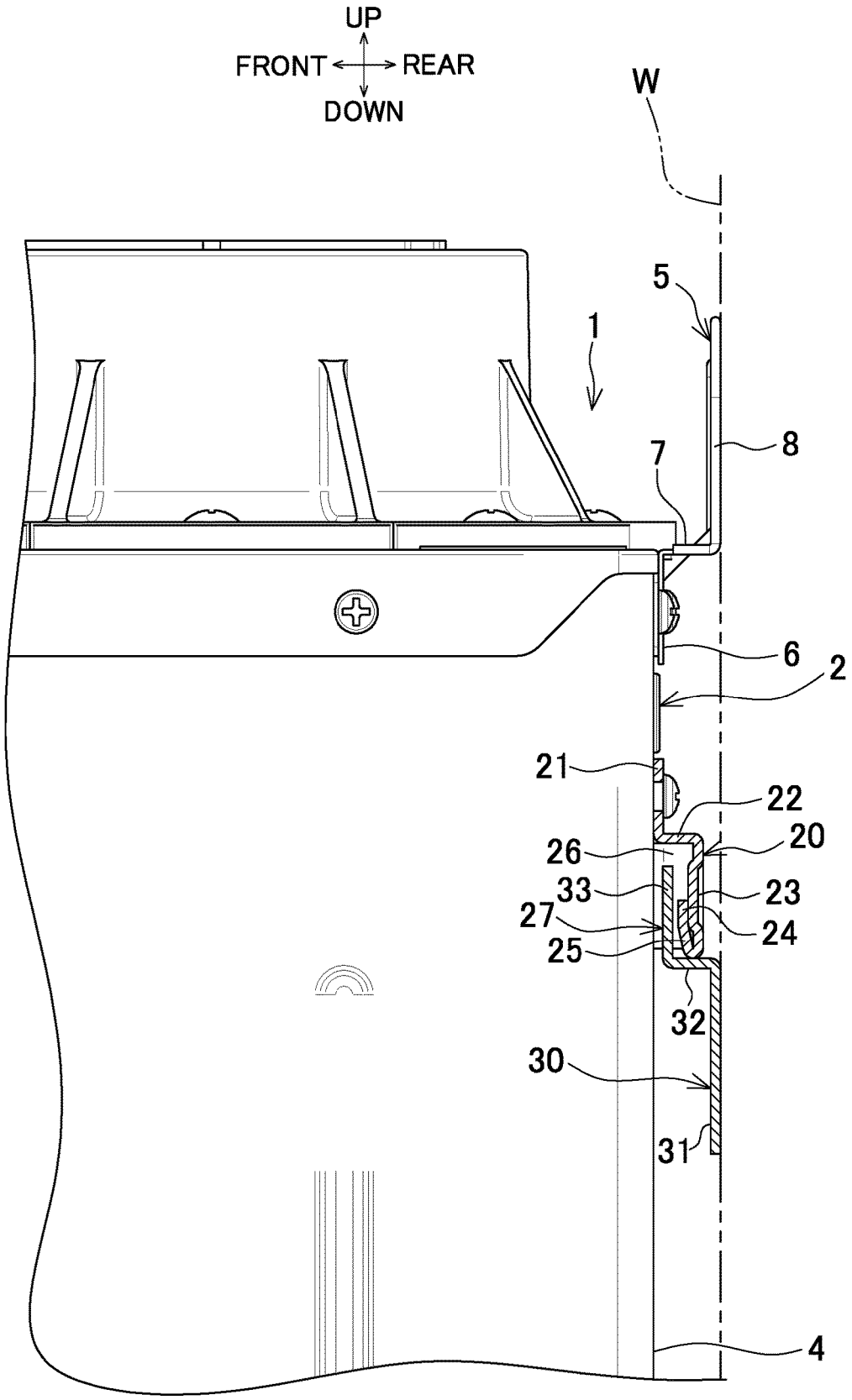
FIG. 6 is an explanatory view illustrating a state where the lock-engagement fitting component has been lock-engaged with the support fitting component as viewed from the side surfaces (both the fitting components are shown as their cross-sections).

Thus, when the lock-engagement plate portion 33 has been inserted relative to the lock-engagement space 27, the lower end of the insertion portion 25 comes into contact with the upper surface of the horizontal plate portion 32, and both the lower plate portion 23 and the turned-back portion 24 lock-engage with the lock-engagement plate portion 33, as shown in FIG. 6. Therefore, the case 2 is hung and supported through the support fitting component 30 by the wall surface W, and alignment in the up-down direction is performed.

Figure 7:
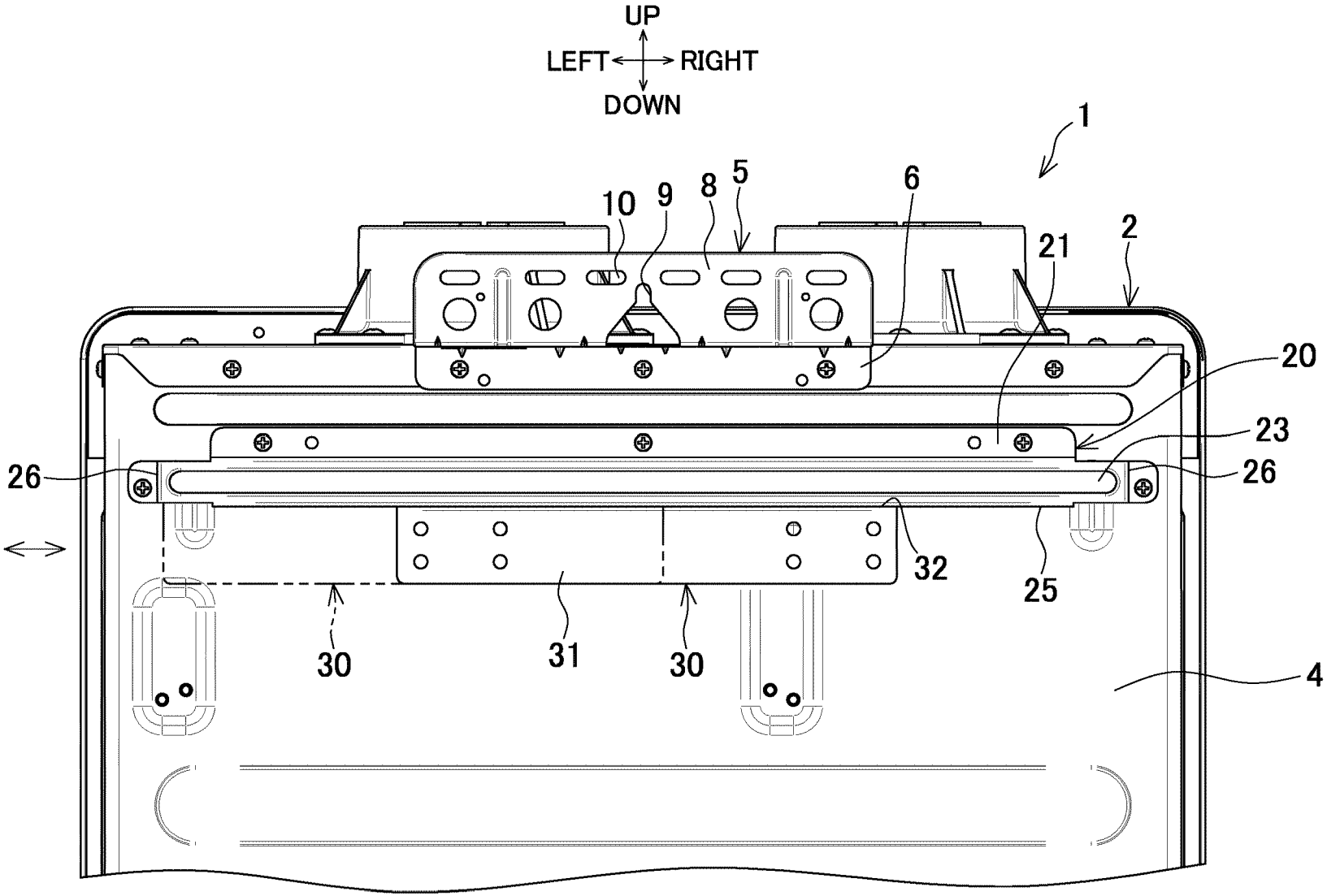
FIG. 7 is an explanatory view illustrating a state where the lock-engagement fitting component has been lock-engaged with the support fitting component as viewed from the back surfaces (the wall surface is not shown).

After the alignment in the up-down direction, as shown in FIG. 7, the case 2 is slid in the left-right direction, and positions of the lock-engagement fitting component 20 and the support fitting component 30 relative to each other are adjusted in the left-right direction, whereby alignment in the left-right direction is also performed. The alignment can be performed in a state where the case 2 is supported by the support fitting component 30, whereby the slight adjustment can be easily performed. The lower plate portion 23 has the stopper pieces 26, 26 on the left and right sides. Therefore, in the alignment in the left-right direction, as indicated by an alternate long and two short dashes line, the support fitting component 30 comes into contact with the stopper piece 26 to regulate sliding. Accordingly, the lock-engagement plate portion 33 does not fall from the lock-engagement space 27.

After this alignment in the left-right direction has also been performed, the wall-side mounting portions 8, 8 of the upper and the lower mounting fitting components 5, 5 are fixed by screwing screws through the fully attaching holes 10 into the wall surface W. Thus, the water heater 1 is mounted to the wall surface W also by the upper and the lower mounting fitting components 5, 5. However, the water heater 1 may be hung and supported merely through the lock-engagement fitting component 20 without using the mounting fitting components 5, 5.

In the structure for mounting the water heater 1 according to the above-described embodiment, the lock-engagement fitting component 20 is mounted to the back plate 4 (back surface) of the case 2, and the lock-engagement fitting component 20 includes the upper plate portion 21 (fixed portion) which is fixed to the back plate 4, and the lower plate portion 23 (lock-engaging portion) that is joined to the upper plate portion 21, is lock-engageable with the lock-engagement plate portion 33 (lock-engaged portion) from above the lock-engagement plate portion 33, and has a dimension longer than that of the lock-engagement plate portion 33 in the left-right direction. The lower plate portion 23 is lock-engaged with the lock-engagement plate portion 33 from above the lock-engagement plate portion 33 to hang and support the case 2 through the lock-engagement fitting component 20 by the support fitting component 30.

In this configuration, the lock-engagement fitting component 20 that is sufficiently longer than the lock-engagement plate portion 33 in the left-right direction can be easily lock-engaged with the support fitting component 30 without visually performing strict alignment. Furthermore, slight adjustment of the left and right mounting positions can be performed in a state where the case 2 is hung and supported by the support fitting component 30, and the case 2 is unlikely to fall during the adjustment. Therefore, alignment can be easily and assuredly performed during the mounting, and workability is made excellent. Furthermore, since the width of the support fitting component 30 is less than that of the lock-engagement fitting component 20 in the left-right direction, the support fitting component 30 does not project from the left and right sides of the case 2 in a mounted state.

Particularly, since the lower plate portion 23 is disposed over almost the entire length of the width of the back surface of the case 2 in the left-right direction, in a case where the lower plate portion 23 is lock-engaged with the support fitting component 30, the lower plate portion 23 can be visually checked easily from the lateral side, and is easily lock-engaged with the support fitting component 30.

The lower plate portion 23 has the turned-back portion 24 at the lower end. The turned-back portion 24 extends in the left-right direction and comes into contact with the support fitting component 30 in a state where the lower plate portion 23 lock-engages with the lock-engagement plate portion 33. Therefore, the turned-back portion 24 comes into line contact with the support fitting component 30 and sliding relative to the support fitting component 30 in the left-right direction is smoothly performed, so that slight adjustment of the left and right mounting positions can be easily performed.

The turned-back portion 24 has the insertion portion 25 in which the thickness in the front-rear direction is increased upward from the lower end so as to form an acute angle, and the front surface of the insertion portion 25 is tilted forward. Therefore, the lower plate portion 23 is easily lock-engaged with the support fitting component 30, and the case 2 and the lock-engagement fitting component 20 are both guided toward the wall surface W by tilting of the front surface when the front surface of the insertion portion 25 has come into contact with the lock-engagement plate portion 33.

The stopper pieces 26 (stoppers) are disposed on both the left and right sides of the lower plate portion 23 for preventing the lock-engagement plate portion 33 from falling from the lower plate portion 23. Therefore, during slight adjustment of the left and right mounting positions, the lock-engagement plate portion 33 can be assuredly prevented from falling from the lock-engagement fitting component 20.

The lock-engagement plate portion 33 is plate-shaped. Therefore, the structure of the support fitting component 30 is simplified, and lock-engagement of the lock-engagement fitting component 20 can also be facilitated.

The mounting fitting component 5 having the provisionally attaching hole 9 and the fully attaching holes 10 is fixed to the back plate 4 above the lock-engagement fitting component 20. The provisionally attaching hole 9 can be lock-engaged with a screw disposed at the wall surface W, and through the fully attaching holes 10, screws can be screwed into the wall surface W. Therefore, the case 2 can be firmly mounted to the wall surface W by also using the mounting fitting component 5. The lock-engagement fitting component 20 can be positioned at a low position, and the support fitting component 30 is also mounted at a position lower than that of the mounting fitting component 5 so as to correspond to the lock-engagement fitting component 20. Therefore, the height to which the case 2 is lifted during the mounting can be lowered. Furthermore, the case 2 may be mounted by selectively using one of the lock-engagement fitting component 20 and the mounting fitting component 5.

The support fitting component 30 is structured to have the fixed plate portion 31 which is fixed to the wall surface W, the horizontal plate portion 32 that is bent forward from the upper end of the fixed plate portion 31, and the lock-engagement plate portion 33 that is bent upward from the front end of the horizontal plate portion 32, and, thus, only the lock-engagement plate portion 33 projects upward. Therefore, when the lower plate portion 23 is lock-engaged with the lock-engagement plate portion 33, the lower plate portion 23 can be smoothly inserted between the lock-engagement plate portion 33 and the wall surface W without interfering with another portion.

Modification examples will be described below.

The width of the lock-engaging portion of the lock-engagement fitting component in the left-right direction is preferably greater than or equal to twice the width of the lock-engagement plate portion of the support fitting component as in the lower plate portion of the above-described embodiment. However, as long as the width of the lock-engaging portion is greater than the width of the lock-engagement plate portion in the left-right direction, the width of the lock-engaging portion in the left-right direction may be less than that in the above-described embodiment. Alternatively, the width of the lock-engaging portion in the left-right direction may be equal to the width of the back plate in the left-right direction.

The insertion portion of the lower plate portion may not necessarily have the forward tilting front surface described above in the embodiment. The lower plate portion itself may have an upward-increasing thickness without providing the turned-back portion.

The stopper is not limited to the stopper piece that is fixed to the back plate as in the above-described embodiment. Bent pieces that are bent forward from both the left and right ends of the lower plate portion may be used as the stoppers. Screws or the like may be separately mounted as the stoppers at both the left and right ends of the lower plate portion. The stopper may be omitted.

Further, in the support fitting component, the width of the lock-engagement plate portion in the left-right direction may be increased or reduced as compared with the above-described embodiment.

Furthermore, the support fitting component may not necessarily have the lock-engagement plate portion extending in the left-right direction as in the above-described embodiment.

Figure 8:
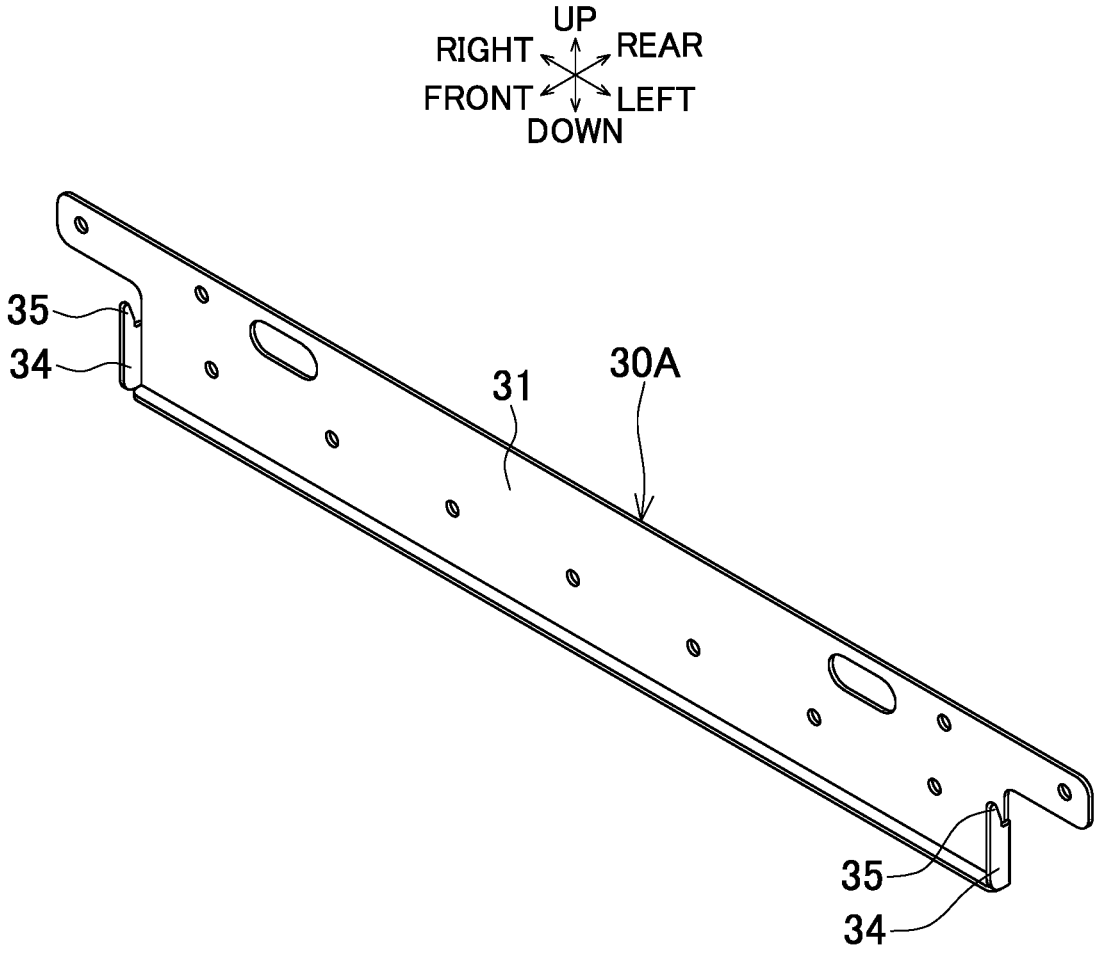
FIG. 8 is a perspective view of a support fitting component, as viewed from the front side, according to a modification example.

FIG. 8 illustrates a support fitting component according to a modification example. A support fitting component 30A includes a pair of lock-engagement plates 34, 34 that are bent forward, on both left and right ends of the fixed plate portion 31 which is screwed to the wall surface W. A distance between the lock-engagement plates 34 and 34 on the left and right sides is greater than the width of the turned-back portion 24 of the lock-engagement fitting component 20 in the left-right direction, and less than the width of the lock-engagement space 27 in the left-right direction. Claws 35, 35 are formed at the upper front ends of the lock-engagement plates 34, 34 so as to extend upward.

Further, in a case where the case 2 is supported by the support fitting component 30A, the lock-engagement fitting component 20 can be lock-engaged. That is, similarly to the support fitting component 30, the back plate 4 is faced toward the wall surface W and the case 2 is lifted to a height at which the lock-engagement fitting component 20 is slightly above the lock-engagement plates 34, 34, and the case 2 is moved backward until the mounting fitting component 5 comes into contact with the wall surface W. In this state, the case 2 is moved downward. Then, the claws 35, 35 of the lock-engagement plates 34, 34 are inserted relative to the lock-engagement space 27 of the lock-engagement fitting component 20, and the lower plate portion 23 is inserted between the claws 35, 35 and the wall surface W.

Figure 9:
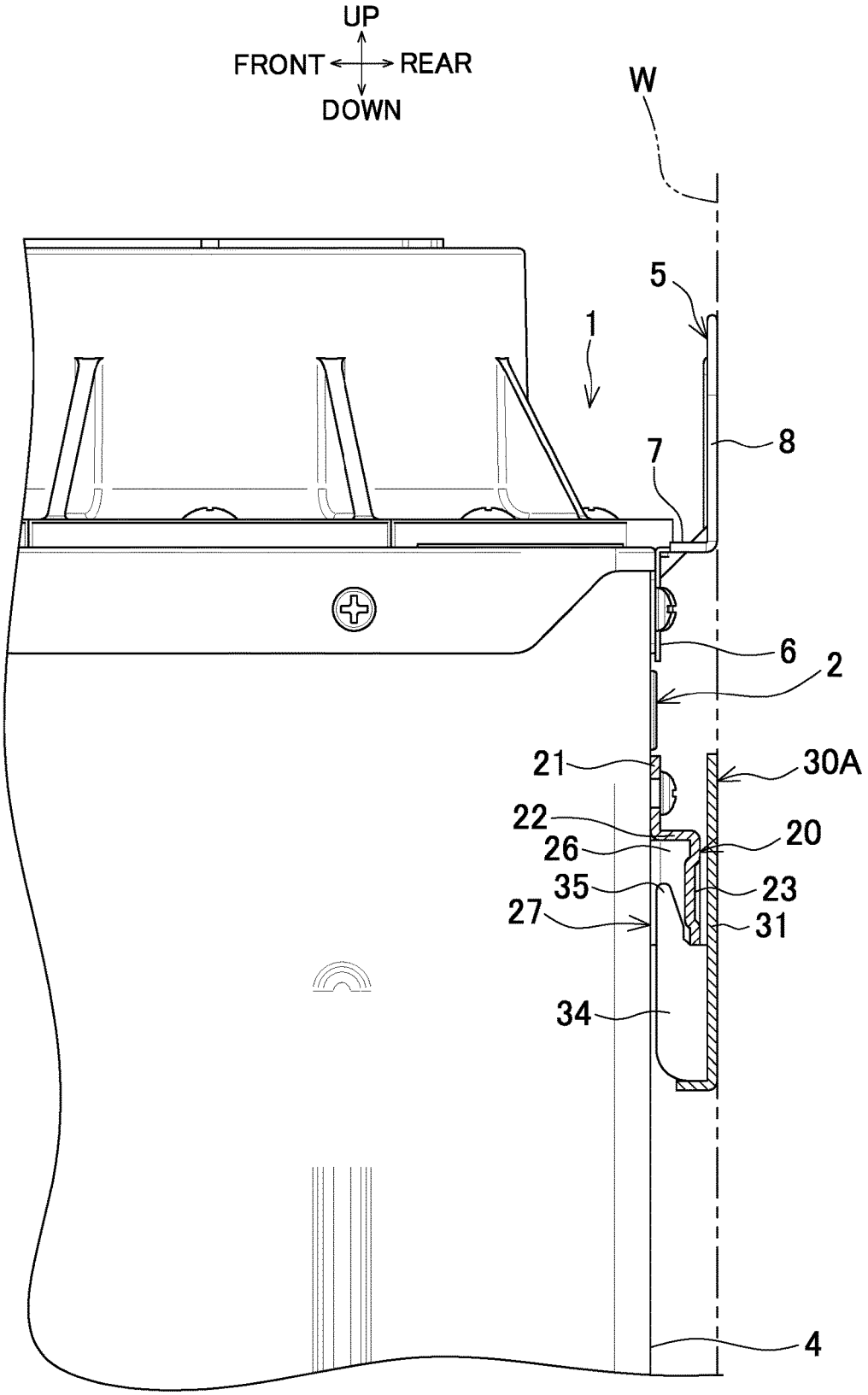
FIG. 9 is an explanatory view illustrating a state where the lock-engagement fitting component has been lock-engaged with the support fitting component according to the modification example as viewed from the side surfaces (both the fitting components are shown as their cross-sections).

Then, as shown in FIG. 9, the lower end of the lower plate portion 23 located on the left and right outer sides of the turned-back portion 24 comes into contact with the upper surfaces of the lock-engagement plates 34, 34, and the case 2 is hung and supported through the support fitting component 30A by the wall surface W, and alignment in the up-down direction is performed.

Moreover, the structure of the water heater itself is not limited to that of the above-described embodiment. The mounting surface may not necessarily be a wall surface, and may be, for example, a separate plate mounted to a wall surface.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A water heater mounting structure for mounting a case in which a burning device is housed, to a mounting surface, via a support fitting component that is fixed to the mounting surface in a vertical direction and that has a lock-engaged portion facing upward, comprising:

a lock-engagement fitting component that is mounted to a back surface of the case and includes a fixed portion which is fixed to the back surface, and a lock-engaging portion that is joined to the fixed portion, is lock-engageable with the lock-engaged portion from above the lock-engaged portion, and has a dimension longer than that of the lock-engaged portion in a left-right direction;

wherein the lock-engaging portion is lock-engaged with the lock-engaged portion from above the lock-engaged portion to hang and support the case through the lock-engagement fitting component by the support fitting component; and wherein the lock-engaging portion has, at a lower end, a turned-back portion that is turned back towards a front side of the lock-engaging portion and that extends substantially in an upward direction from the lower end so as to overlap the lock-engaging portion.

2. The water heater mounting structure according to claim 1, wherein the lock-engaging portion is disposed over almost an entire length of a width of the back surface of the case in the left-right direction.

3. The water heater mounting structure according to claim 1, wherein the lock-engaging portion has, at a lower end, a turned-back portion that extends in the left-right direction, and that comes into contact with the support fitting component in a state where the lock-engaging portion is lock-engaged with the lock-engaged portion.

4. The water heater mounting structure according to claim 3, wherein the turned-back portion has an insertion portion in which a thickness in a front-rear direction is increased upward from a lower end so as to form an acute angle, and the insertion portion has a forward tilting front surface.

5. The water heater mounting structure according to claim 1, wherein stoppers for preventing the lock-engaged portion from falling from the lock-engaging portion are disposed on both left and right sides of the lock-engaging portion.

6. The water heater mounting structure according to claim 1, wherein the lock-engaged portion is plate-shaped.

7. The water heater mounting structure according to claim 1, wherein a mounting fitting component is fixed to the back surface above the lock-engagement fitting component, and the mounting fitting component has a provisionally attaching hole that is lock-engageable with a screw disposed at the mounting surface, and a fully attaching hole through which a screw is screwed into the mounting surface, and the case is mountable to the mounting surface through the mounting fitting component in a state where the case is hung and supported by the support fitting component.

8. The water heater mounting structure according to claim 1, wherein the support fitting component includes a fixed plate portion which is fixed to the mounting surface, a horizontal plate portion that is bent forward from an upper end of the fixed plate portion, and the lock-engaged portion that is bent upward from a front end of the horizontal plate portion.

* * * * *